US008304719B2

(12) United States Patent
Wang et al.

(10) Patent No.: US 8,304,719 B2
(45) Date of Patent: Nov. 6, 2012

(54) PRECISE AND THOROUGH BACKGROUND SUBTRACTION

(76) Inventors: Xin Wang, Princeton, NJ (US); Haiying Zhang, Princeton, NJ (US)

( * ) Notice: Subject to any disclaimer, the term of this patent is extended or adjusted under 35 U.S.C. 154(b) by 230 days.

(21) Appl. No.: 12/709,474

(22) Filed: Feb. 20, 2010

(65) Prior Publication Data

US 2010/0213368 A1 Aug. 26, 2010

Related U.S. Application Data

(60) Provisional application No. 61/154,419, filed on Feb. 22, 2009.

(51) Int. Cl.
*H01J 49/00* (2006.01)

(52) U.S. Cl. ..... 250/288; 250/281; 250/282

(58) Field of Classification Search ..... 250/281, 250/282, 288
See application file for complete search history.

(56) References Cited

U.S. PATENT DOCUMENTS

| | | | |
|---|---|---|---|
| 5,672,869 | A | 9/1997 | Windig et al. |
| 6,590,204 | B2 | 7/2003 | Baranov |
| 6,717,130 | B2 | 4/2004 | Bateman et al. |
| 7,009,174 | B2 | 3/2006 | Le Blanc |
| 7,329,852 | B2 | 2/2008 | Liu |
| 7,351,956 | B2 | 4/2008 | Le Blanc |
| 7,381,568 | B2 | 6/2008 | Zhang et al. |
| 7,409,298 | B2 | 8/2008 | Andreev et al. |

OTHER PUBLICATIONS

Windig W, et al. A Noise and Background Reduction Method for Component Detection in Liquid Chromatography/Mass Spectrometry. Analytical Chemistry 1996; 68: 3602-3606.

Bell DJ, et al. On-line liquid chromatography/fast-atom bombardment of protein tryptic digests. Rapid Communications in Mass Spectrometry 1990; 4: 88-91.

Ueno T, et al. Computer-aided deduction of mass spectra detected on a photographic plate. III. Background and sample background (undesired components in a mixture) subtraction. Shitsuryo Bunseki 1974; 22: 109-114.

Goodley P, et al. Background-subtraction software to improve LC-MS chromatographic and MS data. American Laboratory 1993; 25: 36B, 36D.

Biller JE, et al. Reconstructed mass spectra, a novel approach for the utilization of gas chromatography-mass spectrometer data. Analytical Letters 1974; 7: 515-528.

Kosjek T, et al. The use of quadrupole-time-of-flight mass spectrometer for the elucidation of diclofenac biotransformation products in wastewater. Journal of Chromatography A, 2008; 1215: 57-63.

Yu X, et al. A Novel LC/MS Background Subtraction Technique for the Detection of Drug Metabolites in Biological Samples. Proceedings of the 47th ASMS conference, 1999.

Thermo Scientific. Performing background subtraction using a control. MetWorks 1.1.0 Online Help Manual.

(Continued)

*Primary Examiner* — Michael Maskell
*Assistant Examiner* — Hanway Chang

(57) ABSTRACT

A method for identifying and characterizing components of interest in complex samples includes subjecting both a sample and its control samples to chromatography/high resolution mass spectrometry analysis to detect ions of the samples. The method includes defining sections of control sample data within specified chromatographic fluctuation time and mass precision windows around each ion or each group of the same ions of question in the test sample data. The defined sections of the control sample data are examined and the maximal intensities are subtracted from respective ions in the test sample. Components of interest are determined from the resultant data of the test sample. The method can be used for identifying molecular ions and/or their fragment ions for components of interest in complex samples.

21 Claims, 10 Drawing Sheets

OTHER PUBLICATIONS

Zhang H, et al. An Algorithm for Thorough Background Subtraction from High Resolution LC/MS Data: Application to Detection of Glutathione-Trapped Reactive Metabolites. Journal of Mass Spectrometry 2008; 43: 1181.

Zhang H, et al. An algorithm for thorough background subtraction from high-resolution LC/MS data: application to the detection of troglitazone metabolites in rat plasma, bile, and urine. Journal of Mass Spectrometry 2008; 43: 1191.

Zhang H, et al. An Algorithm for Thorough Background Subtraction from High Resolution LC/MS Data: Applications to GSH-trapped Reactive Metabolite Screening and Unbiased Detection of Drug Metabolites in Plasma, Bile, and Urine. Proceedings of the 56th ASMS Conference, Jun. 2008, Denver, CO.

Zhang H, et al. Algorithm for Thorough Background Subtraction of High-Resolution LC/MS Data: Application to Obtain Clean Product Ion Spectra from Nonselective Collision-Induced Dissociation Experiments. Anal. Chem. 2009; 81: 2695-2700.

Zhang H, et al. A methodology for complete plasma metabolite profiling and identification with high-resolution LC/MS to address MIST issues in early clinical studies. Proceedings of the 57th ASMS conference, 2009.

Zhu P, et al. A retention-time-shift-tolerant background subtraction and noise reduction algorithm (BgS-NoRA) for extraction of drug metabolites in liquid chromatography/mass spectrometry data from biological matrices. Rapid Commun. Mass Spectrom. 2009; 23: 1563-72.

Zhang H, et al. Pooled Sample Strategy in Conjunction with High-Resolution Liquid Chromatography-Mass Spectrometry-Based Background Subtraction to Identify Toxicological Markers in Dogs Treated with Ibipinabant. Anal. Chem. 2010; 82: 3834-3839.

Rozman E, et al. Ebrotidine and its metabolites studied by mass spectrometry with electrospray ionization. Comparison of tandem and in-source fragmentation. Rapid Commun. Mass Spectrom. 1995; 9: 1492.

Meng CK, et al. Peptide sequencing with electrospray ionization on a magnetic sector mass spectrometer. Rapid Commun. Mass Spectrom. 1990; 4: 151.

Clayton E, et al. Precursor ion and neutral loss scanning on quadrupole and sector time of flight mass spectrometers in real time LC-MS. Adv. Mass Spectrom. 2001; 15: 403.

310. Apply the fluctuation time window

320. Apply the mass precision window

330. Conduct background subtraction

340. Loop the above processes throughout test sample scans.

FIG. 4a
FIG. 4b
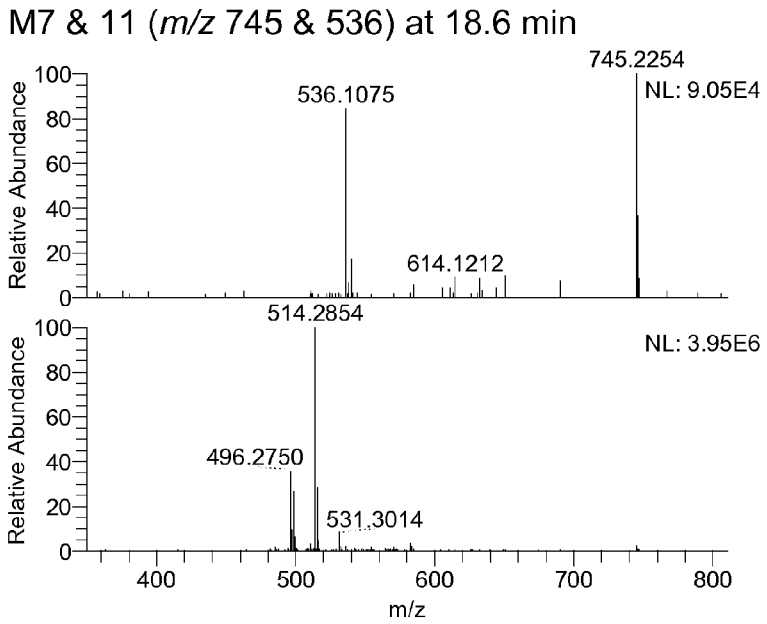
FIG. 4c
FIG. 4d
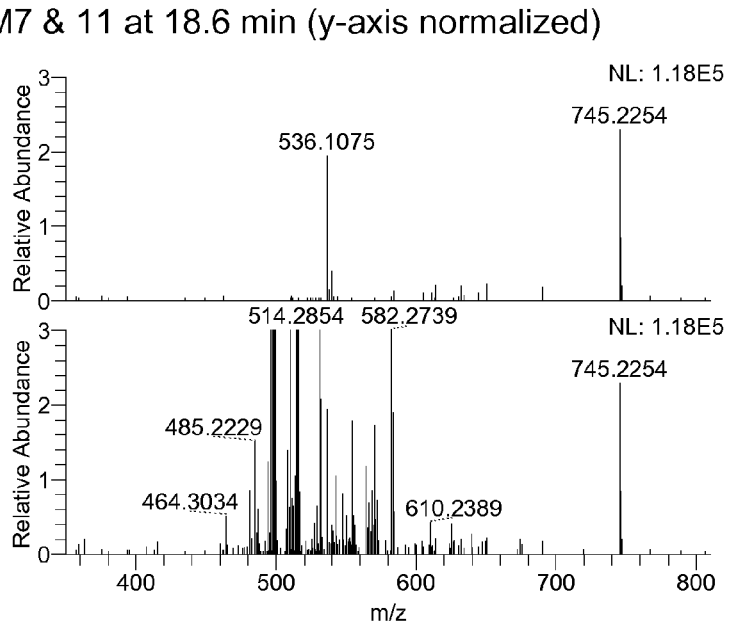

NL: 1.93E7

NL: 1.67E6 drug
NL: 1.45E6
drug metabolite

NL: 1.67E6
100
80
60
40
20
0
1
2
3
4
5
6
7
8
9
Time (min)

PRECISE AND THOROUGH BACKGROUND SUBTRACTION

CROSS-REFERENCE TO RELATED APPLICATIONS

This application claims the benefit of provisional patent application Ser. No. 61/154,419 filed 2009 Feb. 22 by the present inventors.

FIELD OF INVENTION

The invention generally relates to the field of mass spectrometry and more particularly to the removal of extraneous signals arising from sample matrix components in data of chromatography/high resolution mass spectrometry analysis for the identification and characterization of components of interest.

BACKGROUND OF INVENTION

Mass spectrometers are often coupled with chromatography systems in order to identify and characterize components of interest in a test sample. In such a coupled system, the eluting components from a chromatographic system are ionized in a mass spectrometer and a series of mass spectra are obtained at small time intervals, ranging from, for example, 0.01-10 seconds, for the duration of the chromatographic process. Each mass spectrum records the m/z values and intensities for all ions detected at each time point along the chromatographic time scale. As a test sample may contain many components (i.e., chemical entities), it is challenging to identify the components of interest amid complex mixtures in the resultant data.

The issue of signals arising from sample matrix components is the major confounding factor to the identification of components of interest in a complex sample. Other factors that may confound the analysis include random instrument noise and chemical background. Typically, the random instrument noise in a modern high resolution instrument, e.g., a Fourier transform type of instrument, is at low intensity levels and is not a primary concern. In addition, there have been a number of algorithms developed over the years to deal with noise, including Component Detection Algorithm (CODA) [Windig W, Payne A W. U.S. Pat. No. 5,672,869, Sep. 30, 1997], Sequential Paired Covariance [Muddiman D C, Rockwood A L, Gao Q, Severs J C, Udseth H R, Smith R D. *Anal. Chem.* 1995; 67: 4371], and Windowed Mass Selection Method [Fleming C M, Kowalski B R, Apffel A, Hancock W S. *J. Chromatogr. A,* 1999; 849: 71-85], for example. Chemical background signals are typically originated from solvents, column residues, and ion source contaminants; and they are typically common to all samples in an analysis.

In order to illustrate the major issue of sample matrix components to LC/MS analysis of complex samples, base peak ion chromatograms of an example discussed hereafter are shown in FIGS. 1*a* and 1*b*. A base peak ion (BPI) chromatogram presents a profile consisting of signals of the most intense ion in each mass spectrum acquired along the chromatographic time scale. The BPI chromatogram in FIG. 1*a* is obtained from LC/MS analysis of a human liver microsomal incubation sample containing buspirone metabolites. This is a relatively simple in vitro sample without significant sample matrix-related signals to alter the profile of the buspirone metabolite peaks. Chemical background and random instrument noise are present at such insignificant levels that they do not affect the profile. Therefore, all distinct peaks exhibited in FIG. 1*a* represent buspirone and its metabolites. However, when the same buspirone metabolite sample was reconstituted into a complex sample matrix, e.g., human plasma, the resultant BPI chromatogram (FIG. 1*b*) is complicated by additional peaks arising from sample matrix components, making the identification of buspirone metabolite peaks difficult.

A variety of approaches and data acquisition & analysis software associated with mass spectrometers have been developed to identify components of interest in complex samples. Some approaches target a specific behavior or property of potential components of interest in either the data acquisition stage or the data analysis stage to facilitate their identification (e.g., based on their molecular ion masses or fragmentation patterns, as known in the art). However, such approaches may miss potential components of interest that deviate from the targeted behavior or property. An alternative approach is background subtraction, by which signals arising from sample matrix components as well as chemical background are checked and subtracted from the data of a test sample based on their presence in a control sample [Ueno T, Sueyoshi T, Tanaka E, Jinkawa R, Hamada A, Takegami Y. *Shitsuryo Bunseki* 1974; 22, 109-114] [Goodley P, Imitani K, *Am. Lab,* 1993; 25, 36B-36D]. In reality, however, the task of background subtraction is significantly complicated and difficult to implement in mass spectrometric applications where chromatography is involved.

Many vendors of mass spectrometer and software systems provide background subtraction or similar functions. As a typical example, Thermo Fisher Scientific markets a background subtraction tool which is based on a scan-for-scan spectral subtraction operation for data between the test and control samples at each chromatographic time point. (A scan here refers to a time event at which a mass spectrum is acquired.) It also offers options to specify a time window around the time point of each mass spectrum of the test sample to search for a suitable background spectrum in the corresponding control sample data or to average the control spectra within the time window into one background spectrum before performing the subtraction operation. As another typical example, Waters Corporation markets a Control Sample Comparison tool where extracted ion chromatograms are generated at a user-specified mass width stepping throughout the mass range for both the test and control sample data. Extracted ion chromatograms between the test and control samples are compared at each mass width step for the identification of prominent peaks in the test sample.

The above mentioned background subtraction functions can provide adequate results in applications of relatively simple samples including some in vitro sample analysis where components of interest are major and may be detected fairly easily. However, when dealing with more complex samples such as biological fluids, (e.g., urine or plasma extracts) or complex mixtures (e.g., impurity analysis for drug products formulated in polymeric emulsifiers), a multitude of sample matrix components may be encountered whose signals are often dominant and whose masses fall in a range such that isobaric interferences (i.e., of the same nominal m/z values) to the components of interest are almost always observed. In addition, the temporal variability of sample matrix components (i.e., their chromatographic time fluctuations between runs) are often difficult to control because of the matrix effect caused by differing amounts of sample matrix components loaded on a chromatography system.

For the scan-for-scan based background subtraction tools, the main problem is the chromatographic time fluctuations of components between the control and test samples, which prevents thorough removal of signals of chemical background and sample matrix components. The issue of chromatographic time fluctuations remains even with the option of specifying a time window to search for a suitable background spectrum. This is because components may behave differently from each other in terms of their temporal variability and there may not be a suitable spectrum to represent the diversity of chromatographic time fluctuations for all components in question. In addition, the option of spectral averaging seems to cause data degeneration and further impairs the background subtraction for complex samples. For the Control Sample Comparison tools, the comparison is done in an indirect way by first converting the data to extracted ion chromatograms and then comparing peaks formed in the chromatograms. This indirect approach is quite complicated and involves peak definition, smoothing, integration, defining a threshold value and some other parameters. In addition, the rendering of the data to extracted ion chromatograms at arbitrary mass widths may intrinsically cause some data degeneration. For example, isobaric interferences of sample matrix components may be overwhelming and overshadow peaks of components of interest. This may be partially alleviated by generating extracted ion chromatograms at a narrower mass width for data obtained from a high resolution mass spectrometer (e.g., a Time-of-Flight or Fourier Transform type of instrument). However, since the steps of mass widths are systematically set throughout the mass range, they may not be optimally set around the exact masses of components in the samples and still cause inaccurate chromatographic profiling and data comparison for complex samples. An additional disadvantage of such extracted ion chromatogram-based approach is that the processed results typically can only be viewed with special vendor-provided browsers and cannot be verified by ways of BPI chromatogram or total ion chromatogram and the associated spectral examination that are common practices for the examination of mass spectrometric data, as known in the art.

It will be appreciated that the diversity of chromatographic time fluctuations of components should be taken into consideration to allow for thorough removal of signals arising from extraneous components in a sample. It will also be appreciated that the precise comparison of components in a test sample against those in the control samples with the undegenerated exact mass data is of importance for correct identification and subtraction of extraneous components. Accordingly, the present invention provides improved methods for background subtraction using control samples. A precisely and thoroughly background-subtracted data would allow for the detection of components of interest in complex samples.

In sample analysis with a chromatography/mass spectrometry system, it is desirable to not only identify the molecular ions for components of interest but also to obtain their fragment ion spectra for structural characterization. Typically a fragment ion spectrum is obtained in a tandem mass spectrometry (MS/MS) mode where a specific precursor ion (typically the molecular ion of a component) is selected and activated by a collision-induced disassociation process (CID), followed by subsequent analysis of the product ions (i.e., fragment ions) formed. Vendors of a number of mass spectrometer systems provide real time data-dependent MS/MS acquisition functions to allow for automatic generation of product ion spectra (i.e., fragment ion spectra) for certain precursor ions. In a data-dependent MS/MS acquisition approach, precursor ions can be limited to certain components of interest relying on a use-and-inclusion list or by using more specific survey scans such as neutral loss, precursor and enhanced multiply-charged scans, as known in the art. However, these approaches presume some knowledge of the components of interest, which is not always the case. Alternatively, a dynamic background signal exclusion process [Le Blanc, U.S. Pat. No. 7,351,956 B2, Apr. 1, 2008] can be used to obtain MS/MS spectra for more components in a sample. Although this approach can generate MS/MS spectra for a multitude of components in a complex sample, it lacks the ability to differentiate whether they are of interest or not.

It is known in the art that fragment ions may also be obtained using in-source fragmentation techniques that activate all ions in the ion source instead of activating only specific precursor ions. For example, Thermo Scientific markets a source CID technique for some of its instruments by which ion fragmentation occurs between the skimmer and the first multipole region for all ions passing through the region. Alternatively, Clayton et al reported a low-and-high collision energy switching technique on a quadrupole time-of-flight mass spectrometer [Clayton, E.; Bateman, R. H.; Preece, S.; Sinclair, I. Advances in Mass Spectrometry (2001), 15, 403-404.] to obtain both a molecular ion data set at low collision energy and a fragment ion data set at high energy. Both of the above mentioned CID techniques are conducted in non-selective manner as oppose to the foregoing described CID processes conducted in MS/MS mode. The advantage of non-selective CID techniques is that they generate fragment ions for all precursor ions formed in the ion source without missing anyone. However, the problem of non-selective CID techniques is that fragment ions generated may not be easily assigned to a precursor ion due to the non-specific nature of the CID activation, thus making the fragment ion information useless for elucidating the structure of a precursor ion of interest.

It will be appreciated that fragment ions from extraneous precursor ions should be removed so that relevant fragment ion information can be correctly assigned to the components of interest for structural elucidation. A precisely and thoroughly background-subtracted data should allow for the removal of extraneous fragment ion signals arising from chemical background and sample matrix components so that clean fragment ion spectra (also known as product ion spectra) comprising mainly relevant fragment ion information can be obtained for components of interest.

SUMMARY OF INVENTION

Generally speaking, systems and methods according to the invention are able to detect molecular ions and/or their respective fragment ions for components of interest in complex samples by precise and thorough background subtraction using control samples. The background subtraction is preferably carried out by considering all data of control sample(s) within a chromatographic fluctuation time window around a piece of data in a test sample to address the diversity of chromatographic time fluctuations to achieve thorough background subtraction, and by considering only ions in the control sample data whose exact mass m/z values fall within a mass precision window centered around the exact mass m/z values of ions in the test sample data to achieve precise background subtraction.

In one aspect, a method for detecting and identifying components of interest in complex samples is disclosed. A complex sample means any sample that contains not only components of interest but also components other than the components of interest whose signals are significant in the data. Examples of complex samples can be found in drug metabolite analysis with biological fluid (plasma, urine, bile, fecal extracts, etc.), drug product analysis with high content of formulating agents, and biomarker analysis where other endogenous components are significant. The method includes subjecting a test sample and one or more of its control samples to a chromatography and high resolution mass spectrometry analysis. A test sample contains components of interest as well as extraneous sample matrix components in the sample, whereas a control sample or control samples are expected to contain all, or virtually all, of the extraneous sample matrix components that are likely presented in the test sample. Control samples contain none or significantly less amount of the components of interest. Control samples may or may not contain extra components that are not present in a test sample.

The analysis results in the obtaining of a series of mass spectrometric data along the chromatographic time scale. The chromatographic time of a component (e.g., the time point of its apex intensity) between runs may fluctuate and the fluctuations of different components may or may not be of the same length or in the same direction, but they are within a typical chromatographic time range (e.g., less than 0.3 minute). The measured exact mass m/z values of the same components in the data between runs are not expected to be exactly the same, but they are within a typical mass precision range (e.g., within 10 ppm). Mass precision describes the uncertainty of mass measurements, i.e., the mass difference between measurements of an ion. It is typically expressed as a relative number using the ratio of the mass difference between measurements versus the m/z value of an ion, and is commonly expressed as parts per million (ppm), as know in the art.

The method includes specifying a chromatographic fluctuation time window (typically less than 0.5 minute) to accommodate the diversity of chromatographic time fluctuations for comparing components between the test and control runs. All data in the control samples within the chromatographic fluctuation time window relative and centered around each time point of the test sample are considered for comparison with data at that time in the test sample. The method also includes specifying a mass precision window (typically less than 50 ppm) around exact masses of the test sample data for comparing components in the test sample data against those in the control sample data. The combined definition of the chromatographic fluctuation time window and the mass precision window around ions in the test sample data first allows matrix components in the control samples to be thoroughly captured regardless of their chromatographic time fluctuations relative to the same matrix components presented in the test sample data for subtracting them from the test sample data, and secondly prevents unrelated isobaric components from entering into the defined section of the control sample data to cause any erroneous subtraction of components of interest in the test sample.

With the combined specification of both the chromatographic fluctuation time window and the mass precision window, the background subtraction of any ion in the test sample can be performed by, e.g., subtracting the maximal intensity of ions in the defined section of the control sample data or by subtracting this intensity scaled with a multiplying factor. If no ions are identified in the defined section of the control sample data, then the ion in the test sample data is kept unchanged.

The resultant data after the aforementioned process can be viewed using, e.g., base peak ion chromatogram or other data visualization techniques to identify peaks of interest. The spectra of the peaks can also be examined to determine ions of interest.

This method can be used alone or it can be combined with other data processing or viewing methods. For example, a noise reduction algorithm can be included to reduce random noise. This can be done by simply removing any ions whose exact mass within a mass precision window do not appear in the adjacent scans, or by Windowed Mass Selection Method or any other methods based on the random nature of the instrument noise. Also, the Biller-Biemann algorithm can be used to resolve closely eluted peaks. In addition, mass defect filtering and other techniques can be used to further classify or differentiate the detected components into different groups. The combination of methods can be in different orders. For example, a noise reduction process can be conducted before or after or simultaneously with the background subtraction process.

In another aspect, a system for detecting and identifying components of interest in complex samples is disclosed. The system according this aspect comprises test and control sample sets, chromatography and high resolution mass spectrometer, and computing device.

In a further aspect, a computer readable medium containing instructions is disclosed. The instructions, when executed on a computer, cause the computer to perform a method to precisely and thoroughly subtract signals arising from chemical background and sample matrix components that are also present in the control sample data.

In other aspects, methods and systems are disclosed for obtaining clean fragment ion spectra comprising mainly relevant fragment ion information from non-selective fragmentation experiments for identifying and characterizing components of interest in complex samples.

In other aspects, methods and systems are disclosed for identifying both molecular ions of components of interest and their fragment ions from experiments containing both molecular ion data sets and non-selective fragment ion data sets. Because of the chromatographic integrity between the molecular ion and fragment ion data sets, such methods and systems allow for the correlation and further analysis of the molecular ions and their respective fragment ions.

BRIEF DESCRIPTION OF THE DRAWINGS

The foregoing and other aspects of the invention will become more apparent from the following description of specific embodiments thereof and the accompanying drawings which illustrate, by way of example only and not intending to be limiting, the principles of the invention. In the drawings.

FIGS. 4*a*-4*d* illustrate mass spectra of troglitazone metabolites at a particular chromatographic time point in unprocessed and processed forms;

DETAILED DESCRIPTION OF PREFERRED EMBODIMENTS OF THE INVENTION

The following discussion describes certain embodiments of Applicants' invention as best understood presently by the inventors. It is, however, expressly noted that the present invention is not limited to these embodiments. It will be appreciated that numerous modifications of the invention are possible and that the invention may be embodied in other forms and practiced in other ways without departing from the spirit of the invention. Moreover, it is to be understood that the features of the various embodiments described herein are not mutually exclusive and can exist in various combinations and permutations, even if such combinations or permutations are not made express herein, without departing from the spirit and scope of the invention. The Drawings provided herewith and the present detailed descriptions are therefore to be considered as illustrative explanations of aspects of the invention, and should not be construed to limit the scope of the invention. The scope of the invention is defined by the appended claims.

In exemplary embodiments, a data processing method in conjunction with control samples can be applied to remove interferences from chemical background and sample matrix components other than the components of interest in chromatography/high resolution mass spectrometry analysis of complex samples. The method can be used to detect molecular ions and/or their respective fragment ions for components of interest in complex samples. Embodiments of the method include a way of thoroughly examining all data of control sample(s) within a chromatographic fluctuation time window around each time point of a test sample to accommodate the diversity of chromatographic time fluctuations to determine the most appropriate ions for subtraction from the test sample at that time point, and a way of precisely subtracting only those ions in the control sample data whose exact mass m/z values fall within a mass precision window centered around the m/z values of ions detected in the test sample.

Figure 2:
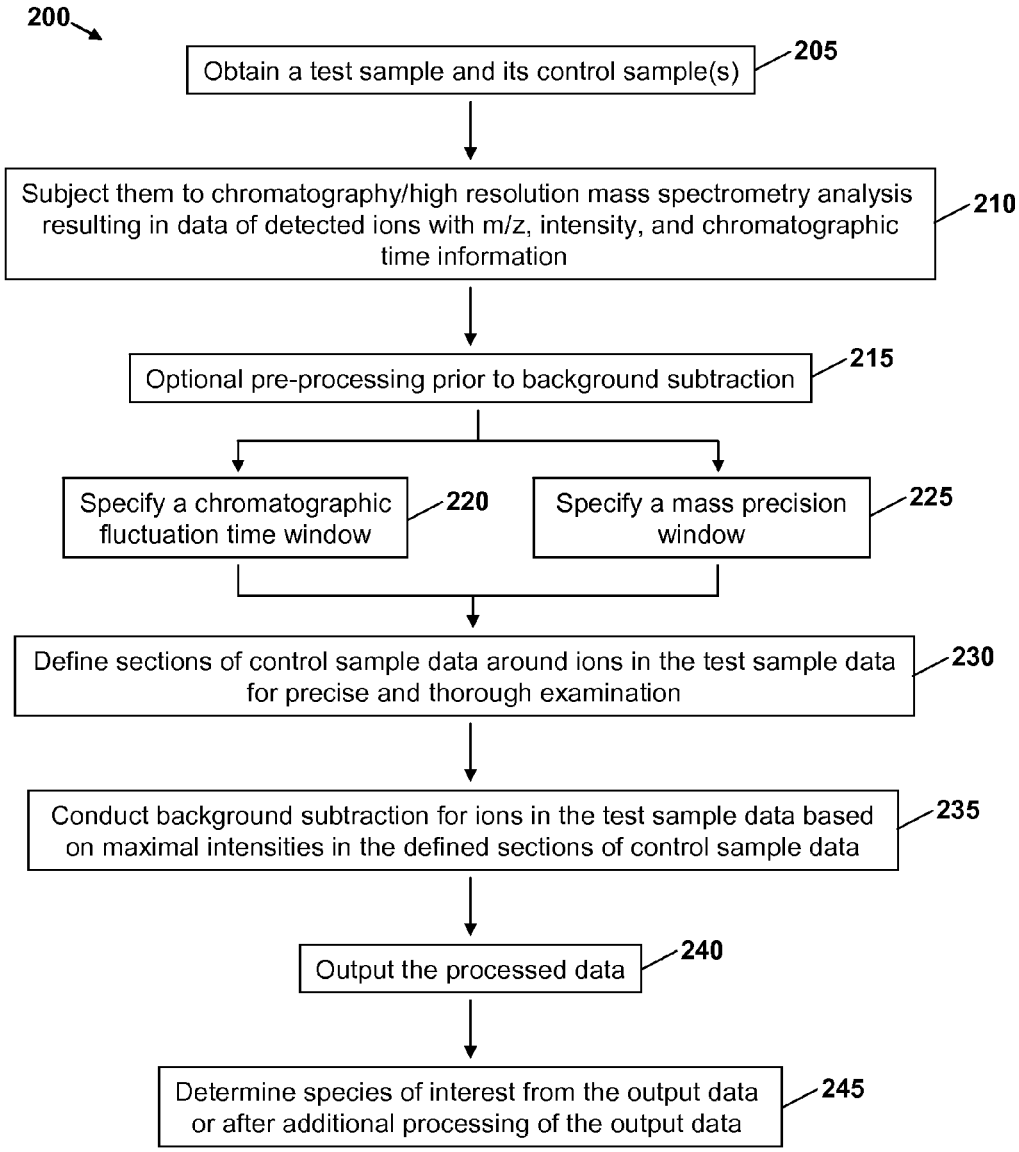
FIG. 2 illustrates a method in accordance with exemplary embodiments of the present invention.

Referring to FIG. 2, a method 200 in accordance with exemplary embodiments commences at step 205 by obtaining a test sample and its control sample(s). A test sample contains components of interest as well as extraneous components in the sample, whereas a control sample or control samples are expected to contain all, or virtually all, of the extraneous sample matrix components that are likely presented in the test sample but contain none or significantly less amount of the components of interest. The control samples may or may not contain extra components that are not present in the test sample.

At step 210, the chromatography and high resolution mass spectrometry analysis results in the obtaining of a series of mass spectra comprising m/z values and intensities of detected ions for the duration of the chromatographic process for both the test and control samples. Since the data sets of the test and control samples are acquired using the same chromatography/mass spectrometry conditions, the chromatographic elution time of a component between the test and control sample runs may shift and the shifts of different components may or may not be of the same length or in the same direction but they are typically within a chromatographic fluctuation time range (e.g., less than 0.3 minute). Also, the measured exact mass m/z values of the same components in the data sets between the test and control sample runs may or may not be exactly the same but they are typically within a certain mass precision range (e.g., within 10 ppm). The range of the chromatographic time fluctuations and the range of the mass measurement precisions define a chromatographic fluctuation time window (see step 220 below) and a mass precision window (see step 225 below). These ranges may be determined based on the observed trends between the test and control sample data sets after examination of the acquired data. Or the chromatographic fluctuation time and mass precision windows may be specified based on the expected performances of the chromatography/mass spectrometer system in that regard without examination of the acquired data, for example.

An optional pre-processing step at step 215 may be performed prior to the background subtraction to extract a desired subset of data for those data sets that are obtained from multiple types of data acquisitions, e.g., extracting the full scan subset out of the data from a data-dependent MS/MS acquisition, as known in the art. A pre-processing step may also involve restricting the initial m/z range or chromatographic time range of the data set to a smaller portion, or extracting a representative subset of the data out of the whole set. A pre-processing step may be a noise reduction process to eliminate random noise in the data set. Such process thus constitutes a means for reducing random noise. This can be done by simply remove any ions in a scan event (i.e., a chromatographic time point) whose equivalent m/z ions within a mass precision window does not exist in the data of the adjacent scan events immediately before and after it, or it can be done with the more advanced Windowed Mass Selection Method, or any other algorithms based on the random-appearing nature of the instrument noise. A pre-processing step may be any other data processing techniques. A pre-process step generally enhances the output of the background subtraction process or improves the speed of the background subtraction process. Step 215 may be omitted and the flow of the method proceeds directly to step 220. For instance, this can be the case where the only type of data in the data set is the full scan data and the random instrument noise from a typical high resolution mass spectrometer can be at an insignificant level.

At step 220, to accommodate the diversity of chromatographic time fluctuations of different sample matrix components between runs to ensure thorough subtraction of sample matrix components, the method defines a range of control sample data within a specified chromatographic fluctuation time window along the chromatographic time scale around each time point of the test sample data set. The time window specified is based on the range of chromatographic time fluctuations observed/expected of the chromatography/mass spectrometry system and can be set to two times or even wider than the maximum observed/expected chromatographic time fluctuation. For example, if the chromatographic time fluctuation of components between runs observed is less than 0.3 min, the chromatographic fluctuation time window can be set as ±0.3 min or ±0.5 min. All data in the control sample within the specified time window relative and centered around each time point of the test sample data set are considered for comparison with data at that time in the test sample. Although the chromatographic fluctuation time window should be set wide enough to accommodate the diversity of chromatographic time fluctuations, it is not necessary to be set too wide. If the time window is set too wide, it may increase the probability of erroneous subtraction of a component of interest due to potential inclusion of an unrelated mass-matching component, even though the two components are originally time-resolved in the data sets.

At step 225, to deal with the isobaric interference to ensure that components of interest are not to be erroneously subtracted, the method defines a range of control sample data falling within a specified mass precision window around the exact m/z values of ions detected in the test sample data set. The mass precision window specified is based on the range of mass measurement precisions observed/expected of the chromatography/mass spectrometry system and can be set to be two times or even wider than the maximum observed/expected mass measurement precision. For example, if the mass precision of components between runs observed is less than 10 ppm, the mass precision window can be set as ±10 ppm or ±15 ppm. Only ions in the control sample data set whose exact mass m/z values fall within the specified mass precision window relative and centered around an ion of question in the test sample data set are considered to trigger the subtraction of that ion in the test sample. Ions in the control sample data set whose exact mass m/z values fall outside of the window will not trigger the subtraction of that ion. Although the mass precision window should be set wide enough to accommodate the mass precision of the data sets, it is not necessary to be set too wide. If the mass precision window is set too wide, it may increase the probability of erroneous subtraction of a component of interest due to potential inclusion of unrelated isobaric interferences.

At step 230, the combined application of the time and mass windows specified at step 220 and step 225 around each ion of question in the test sample data set results in defined sections of control sample data. The background subtraction of any ion in the test sample data set can be performed by considering only ions in the respective defined section of the control sample data set. The combined definition of both the chromatographic fluctuation time window and the mass precision window around ions in the test sample data set is the key to allow matrix components in the control samples to be captured and thoroughly subtracted from the test sample data set regardless of their chromatographic time fluctuations within the specified chromatographic fluctuation time window, and at the same time to prevent unrelated isobaric components outside of the mass precision window from entering into the defined section of the control sample data set to cause any erroneous subtraction of components of interest in the test sample.

At step 235, the method conducts background subtraction for ions in the test sample data set based on examination of the defined sections of control sample data within the chromatographic fluctuation time and mass precision windows around each ion of question in the test sample data set. Thus step 235 constitute a means for subtracting ions in the test sample data set based on examination of respective sections of the control sample data set. If no ions are present within a defined section of the control sample data set, the ion in the test sample data set will be kept un-subtracted. If ions are identified within a defined section of the control sample data set, then the ion in the test sample data set is to be background-subtracted and there are a number of ways to execute the subtraction. For example, the method can first determine the maximum intensity of ions in the defined section of the control sample data set and then subtract this intensity from the intensity of the ion in the test sample data set. Should the net value of the subtraction falls below zero, the intensity of the ion in the test sample data set may be set to zero or the ion may be annulled from the test sample data set, for example.

According to other exemplary embodiments of the invention, the maximum intensity of ions in a defined section of the control sample data set can be scaled with a specified multiplying factor before being subtracted from that of the ion in the test sample data set. A multiplying factor can be set based on the perception of the extent of the intensity (or amount) differences of sample matrix components between samples. A multiplying factor of, e.g., 2 to 100, may help effective removal of sample matrix ions in typical cases where the amount of matrix components may differ between the test and control sample. Too large a multiplying factor (e.g., greater than 1000) may be set but may not be necessary, as too large a multiplying factor may cause erroneous signal reduction or signal removal for components of interest due to, e.g., trace amount of components of interest present in control sample data set as a result of sample carry-over.

According to an alternative embodiment of the invention, the method can directly zero out the intensity of an ion in the test sample data set solely based on the presence of ions within the defined section of the control sample data set without considering their intensity. This may be applicable to certain situations where there is no sample carryover and the components of interest are not present in the control samples.

At step 240, the method records the background-subtracted intensities of ions in the test sample data set along with their original m/z values and chromatographic time information to an output data file. For ions whose counterparts are not present within the defined sections of the control sample data set within the chromatographic fluctuation time and mass precision windows, their intensities will be recorded directly to the output data file along with their m/z values and chromatographic time information. In accordance with the exemplary embodiments of the invention, ions with intensity value of zero may be outputted as such, or the ions may be eliminated from the output data file.

The above background subtraction process is looped through for all ions in the test sample data set for the length of the chromatographic duration until the completion of the process. In exemplary embodiments of the present invention, the completion of the process can be the completion of processing all ions in an original data set, or it can be the completion of processing a subset of the data obtained in a preprocessing step at step 215.

At step 245, the method determines components of interest from the output data of the test sample. This can be done by, e.g., examining a peak profile of the data (using either BPI chromatogram, total ion chromatogram, or other chromatographic peak visualization techniques, as known in the art) and by spectral examination for peaks of interest. BPI chromatogram may be preferred over total ion chromatogram for examining a peak profile if random instrument noise is not removed from the data. Random instrument noise is typically at too insignificant a level to have a substantial impact to the BPI chromatographic visualization. However, total ion chromatogram may sum up all the noises in each spectrum and the summed intensity of the noises may obscure minor peaks of interest in a peak profile of the data.

According to other embodiments of the invention, the output data can also be processed with additional data processing techniques at step 245 to further facilitate the detection of components of interest. For example, the output data can be subjected to mass defect filtering [Zhang, et al, U.S. Pat. No. 7,381,568B2, Jun. 3, 2008]. Thus such additional data processing techniques constitute means being distinct from the means of subtracting ions for processing ions in the test sample data set.

Figure 3:
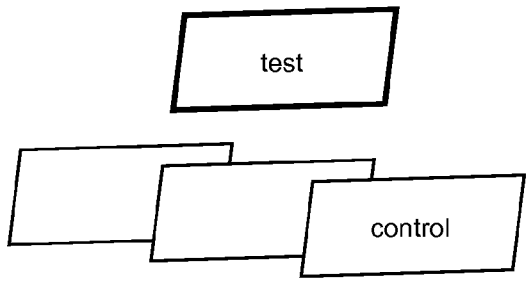
FIG. 3 further illustrates a way to implement the method in accordance with exemplary embodiments of the present invention.
Figure 3:
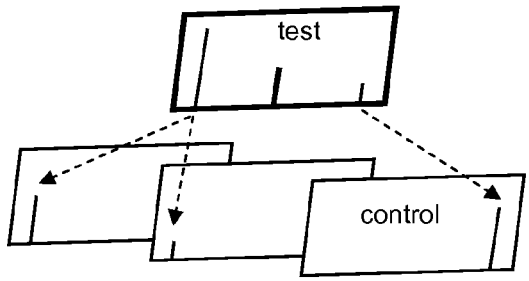
Figure 3:
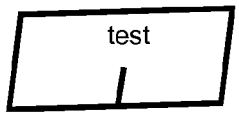

Exemplary ways of implementing aforementioned embodiments of precise and thorough background subtraction methods may be illustrated with reference to a flow chart illustrated in FIG. 3. As known in the art, a series of mass spectra are obtained of the eluting components in a chromatography and mass spectrometry analysis at small time intervals for the duration of the chromatographic process; and a scan is a time event at which a mass spectrum is acquired. The series of the scan numbers and the chromatographic time values are correlated to each other and are inter-convertible. At step 310, the method selects a range of scans in control sample data within a specified chromatographic fluctuation time window around a scan in the test sample data. This, in effect, is the selection of a package of consecutive control spectra (i.e., a range of control sample data) within a specified time window along the chromatographic time scale around a spectrum in the test sample data. At step 320, the method searches the m/z range in the selected spectra of the control sample data based on a mass precision window set around the exact mass m/z value of each ion in the spectrum of the test sample scan. At step 330, the method conducts background subtraction on the spectrum of the test sample scan based on the defined sections of control sample data within the time and mass precision windows resulted from steps 310 and 320. For ions in the spectrum of the test sample who are also present in the defined sections in the control sample data, their intensities are subtracted with the maximum intensities of ions in the defined sections of the control sample data, or are subtracted with the maximum intensities timing a multiplying factor. For ions in the spectrum of the test sample whose counterparts are not found in the defined sections of the control sample data, their intensities are kept without change. Step 340 indicates that the above processes are looped throughout the test sample scans in the data set. The scan loop can be from low scan number to high scan number or from high scan number to low scan number.

In the exemplary ways of implementing the embodiments of precise and thorough background subtraction methods, a number of variations can be made without departing from the spirit and scope of the invention. For example, of the selected package of consecutive control spectra within a chromatographic fluctuation time window, only a subset of spectra representative of the package may be used for background ion identification. For example, control sample spectra of every other scans may be skipped without consideration. This is practical because in typical situations the sampling rate of a mass spectrometer is so fast that the same matrix components are detected on multiple adjacent scans, and therefore the skipping of every other scans or every two scans will not affect the ability to identify and subtract them. In a similar fashion, test sample spectra may be processed and outputted at, e.g., every other scans, instead of every consecutive scans, for certain high sampling rate data.

According to other embodiments of the invention, the background subtraction methods may be implemented in ways other than the aforementioned exemplary ways of implementation without departing from the spirit and scope of the invention. For example, the test sample data may be processed from ions of one mass to ions of another mass, instead of from one scan time point to another scan time point as illustrated in FIG. 3. In other words, the primary loop of the process is based on the mass dimension instead of the scan time dimension of the data: After processing an ion of certain mass in the test sample data, the method moves to another ion of adjacent mass to process. The process can be looped throughout the data from low mass ions to high mass ions or from high mass ions to low mass ions. To apply the precise and thorough background subtraction methods, a section of the control sample data is defined for examination based on a specified chromatographic fluctuation time window along the chromatographic time scale around an ion in the test sample data and a specified mass precision window around the exact mass m/z value of the ion in the test sample data.

In variation of the aforementioned exemplary embodiments, the method can have the option to treat the same ions (i.e., ions falling within a predetermined mass precision window) in adjacent scans in a test sample as a group to define a chromatographic fluctuation time window around the group for selecting control sample data, since the same ions in adjacent scans are the same component eluted along the chromatographic time scale as one peak. With this option, the chromatographic fluctuation time window for selecting control sample data around a group of the same ions can be set, for example, based on the scan time range of the group plus expansions on both sides of it along the chromatography time scale. The expansion on each side can be set to the range of the maximum observed/expected chromatographic time fluctuations or wider. For example, if the chromatographic time fluctuation of components between runs observed is less than 0.3 min, the expansion on each side of the group of ions can be set as 0.3 min or 0.5 min. For time-resolved isomer peaks appearing as separate groups of the same ions in the test sample, separate chromatographic fluctuation time windows are set for each one of them for selecting the respective control sample data. Again, to apply the precise and thorough background subtraction methods, a section of the control sample data is defined for examination based on a specified chromatographic fluctuation time window along the chromatographic time scale around a group of the same ions in the test sample data and a specified mass precision window around, e.g., the medium exact mass m/z value of the group of ions in the test sample data.

In alternative ways of implementing the embodiments of methods, the whole test sample data may be simultaneously processed to define both the chromatographic fluctuation time window and the mass precision window for each ion or each group of the same ions along the mass and chromatographic time dimensions. To apply the precise and thorough background subtraction methods, sections of control sample data are defined for examination based on the above simultaneously defined time and mass windows around each ion or each group of same ions in the test sample data.

In aforementioned various ways to implement the embodiments of methods, a precise and thorough background subtraction of sample matrix component signals in the data of a test sample is conducted based on the examination of defined sections of control sample data within the chromatographic fluctuation time and mass precision windows for each ion or each group of the same ions of question in the test sample data. If no ions are identified within the defined section of the control sample data, the ion or group of same ions in the test sample will be kept un-subtracted. If ions are identified within the defined section of the control sample data, the ion or group of the same ions in the test sample data will be subtracted by, e.g., the maximum intensity of ions identified in the section of the control sample data, or the maximum intensity being scaled with a specified multiplying factor.

In alternative embodiments of the invention, the background subtraction methods can be conducted in conjunction with one or a few other data processing techniques such as random noise reduction and/or mass defect filtering. In other words, when the ions in the test sample data are being examined, a number of actions are taken on them. For example, they may be removed or kept depending on whether they randomly appear in the neighboring scans; they may be filtered or kept depending on whether their mass defects fall within a mass defect filter; and they may be subtracted or untouched depending on whether they are matrix components appearing also in the defined sections of the control sample data. The final results are recorded in the output data.

In accordance with the exemplary embodiments, the background subtraction methods can be used to detect molecular ions for components of interest in complex samples. It should be understood that although the exemplary embodiments of the invention may occasionally be generally described herein in terms of the detection of drug metabolites and endogenous metabolites, its various embodiments can also be applied to many other types of components of interest including degradants, impurities, proteins, peptides, and pesticides for example.

In an experimental analysis of methods in accordance with exemplary embodiments, a bile sample obtained from a rat dosed with troglitazone was analyzed, along with its respective predose sample as a control. High resolution LC/MS data of the troglitazone-dose sample and the predose sample were generated from a commercially available LTQ FT instrument manufactured by Thermo Finnigan, San Jose, Calif. The data of the drug-dosed sample was background-subtracted using the data of the predose sample as control with the following background subtraction settings: chromatographic fluctuation time window, ±1.0 minute; mass precision window, ±10 ppm; multiplying factor applied to the maximal intensity of ion in a defined section of the control sample data, 100.

FIGS. 4*a*-4*d* illustrate the effect of the background subtraction methods on the mass spectra of the drug-dosed sample at a chromatographic time point of 18.6 minutes. Referring to FIG. 4*b*, the mass spectrum obtained from unprocessed data illustrates ions of irrelevant sample matrix components without any showing of distinct drug metabolite ions. In contrast, in FIG. 4*a*, the background-subtracted mass spectrum depicts drug metabolite ions (536.1075 Da and 745.2254 Da) prominently. FIGS. 4*c* and 4*d* are alternative presentations of FIGS. 4*a* and 4*b* with the y-axis normalized to the same absolute intensity scale ($1.18\times10^5$ counts) to further illustrate the effectiveness of the background subtraction. As can be seen, a multitude of sample matrix signals in the unprocessed spectrum (FIG. 4*d*) are thoroughly removed in the background-subtracted spectrum (FIG. 4*c*). The thorough removal of signals from sample matrix components and chemical background in the processed data facilitates the identification of drug metabolite ions that otherwise would not be easily identified.

Figures 1A, 1B:
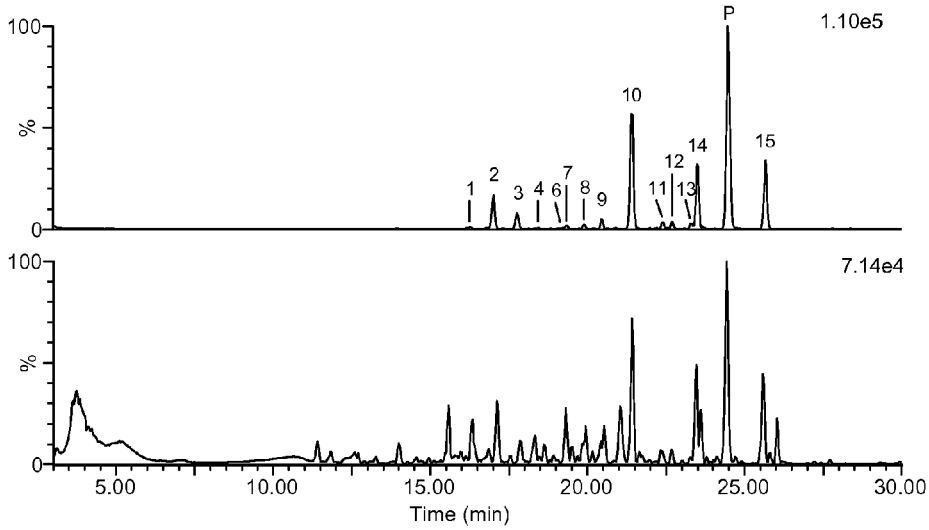
FIGS. 1*a* and 1*b* present base peak ion (BPI) chromatograms of a buspirone metabolite mixture in both in vitro incubation media and in human plasma, illustrating the significant interferences from sample matrix components.
Figure 5A:
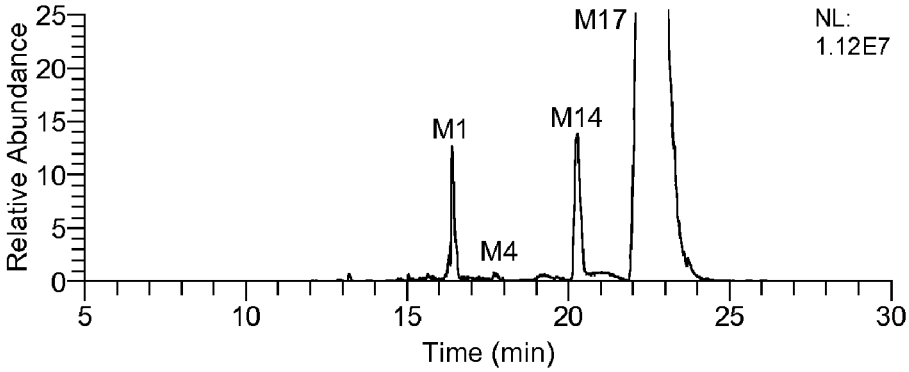
FIGS. 5*a* and 5*b* illustrate BPI chromatograms of troglitazone metabolites in rat bile in unprocessed and processed forms.
Figure 5B:
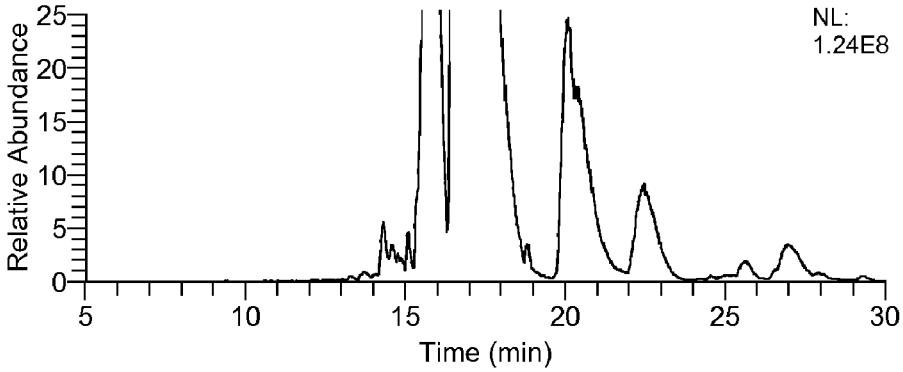

FIGS. 5*a* and 5*b* illustrate the effect of the background subtraction methods on the base peak ion chromatogram of the troglitazone-dosed sample of rat bile. A base peak ion (BPI) chromatogram represents the signals of the most intense ions in mass spectra acquired at each time point along the chromatographic time scale. As illustrated previously in FIG. 1*a* for a relatively simple in vitro sample, a BPI chromatogram can represent the peak profile for components of interest. However, for a complex sample such as plasma or bile that contains a large number of interfering ions arising from sample matrix components, a BPI chromatogram may not reliably indicate the presence of any components of interest in the data. As illustrated in FIG. 5*b*, the unprocessed BPI chromatogram of the rat bile sample shows significant sample matrix signals dominating the profile (e.g., the RT 14-22 min region), making it useless for identifying troglitazone metabolite peaks. In contrast, as illustrated in FIG. 5*a*, the background-subtracted BPI chromatogram reveals the troglitazone metabolites as the only major peaks in the profile (e.g., M1, M4, M14, and M17). Even for minor or co-eluting metabolites, their ions were easily discernible by simple spectral examination of the peak profile at a given time region, as illustrated in the background-subtracted spectra in FIGS. 4*a* and 4*c* for M7 and M11 at 18.6 min.

Figure 6A:
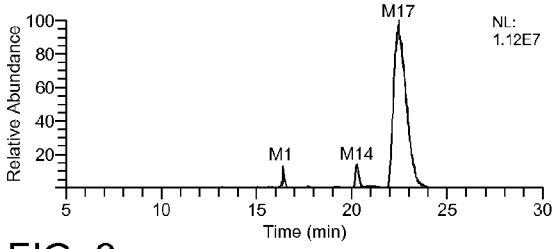
FIGS. 6*a*-6*d* illustrate BPI chromatograms of troglitazone metabolites in rat bile obtained with various background subtraction methods.
Figure 6B:
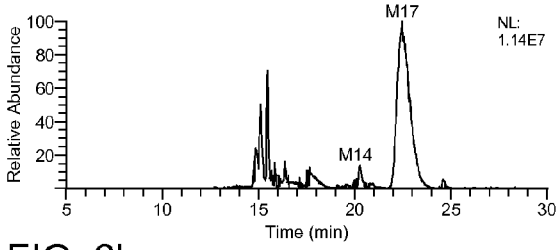
Figure 6C:
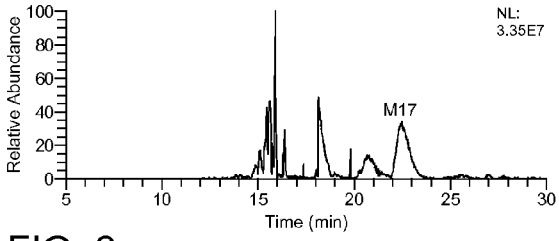
Figure 6D:
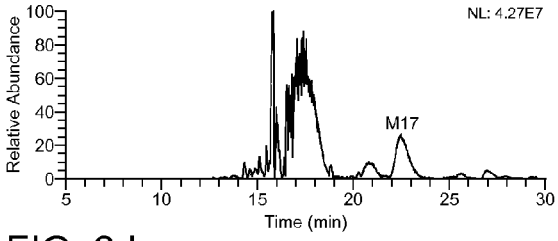

FIGS. 6*a* to 6*d* further illustrate that the effective profiling of troglitazone metabolite peaks in FIG. 5*a* is attributable to the improved background subtraction methods in accordance with the embodiments of the invention. FIG. 6*a* is the full-scale representation of the same profile in FIG. 5*a*. FIGS. 6*b* to 6*d* are profiles of the same original data set processed with existing background subtraction tools provided by Thermo Fisher Scientific, with FIG. 6*b* being from the straight "scan-for-scan" background subtraction utility in Qual Browser of XCalibur™, FIG. 6*c* being from the "search window" option of the background subtraction utility in MetWorks™ (version 1.1), and FIG. 6*d* being from the same "search window" option with the "average background scans" function enabled. Similar processing parameters are used where possible for comparison purposes. For example, for FIG. 6*c* 1-minute search window was set around each mass spectrum of the test sample to search for a suitable background spectrum in the corresponding control sample data, and for FIG. 6*d* 1-minute search window was set to average the control spectra within the time window into one background spectrum before performing the subtraction operation. All four methods used a multiplying factor of 100. The three vendor-provided methods do not provide the option to use a mass precision window around ions in the test sample to prevent potential erroneous subtraction of ions of interest due to co-eluting isobaric interferences. However, based on the profiles shown in FIGS. 6*b* to 6*d*, the more apparent issue with all three vendor-provided methods is their inability to thoroughly remove the overwhelming sample matrix signals presented in bile. As can be seen in FIG. 6*b*, many matrix signals still remain in the RT 14-22 min region with the straight scan-for-scan subtraction utility, illustrating the issue of temporal variability (i.e., chromatographic time fluctuations). The other two vendor-provided methods do allow for using a time window. However, as shown in FIGS. 6*c* and 6*d*, they do not seem to be able to address the issue of chromatographic time fluctuations, resulting in even more remaining matrix signals in the profiles after processing. This is because, even though they use a time window, they are scan-for-scan in concept and are not using all original control sample data within the time window to address the diversity of the chromatographic time fluctuations. The "average background scans" method, as shown in FIG. 6*d*, seems to be the worst among the three, likely due to data degeneration caused by the averaging. In contrast, as illustrated in FIG. 6*a* from the embodiments of the present invention, the use of all control sample data within the chromatographic fluctuation time window allows for effective addressing of the diversity of chromatographic time fluctuations and thorough removal of sample matrix components.

An attempt was made to compare the troglitazone metabolite profile generated from aforementioned precise and thorough background subtraction method as shown in FIG. 6*a* with the output of troglitazone metabolites generated from an extracted ion chromatogram-based control sample comparison method. A direct comparison between the two types of methods is not possible because of the following reasons: (1) the latter is done in an indirect way by rendering the data to extracted ion chromatograms; (2) in addition to control comparison settings, the output of the latter method is also affected by other settings including peak definition, smoothing, integration, threshold settings, and other parameters; and (3) the output of the latter method is not regular mass spectrometric data but rather a list of entries of identified peaks, and can only be visualized by special vendor-provided browsers instead of BPI chromatograms. Nevertheless, the same data sets of the drug-dosed and predose rat bile samples that were used to generate FIG. 6*a* were also processed using the Control Sample Comparison tool in Metabolynx™ version 4.0 provided by Waters. The mass width window was set to 10-mDa width to step throughout the test and control sample data to generate extracted ion chromatograms (as oppose to the mass precision window set around ions in the test samples for precise selection of control ions). The retention time window for peak comparison was set to ±1.0 minute window (as oppose to the time window set around ions in the test samples for selecting the original un-degenerated control sample data). The peak height difference for identifying peaks of interest was set to ±99% (this is a criteria for comparison, rather than a multiplying factor for background subtraction). These three parameters were set to as equivalent as possible to the background subtraction parameters that were used for generating FIG. 6*a*, although the meanings behind the two sets of parameters are different. In addition, other parameters such as peak definition & integration (ApexTrack peak integration), smoothing (mean smoothing of ±2 scans), intensity threshold (1%), absolute peak area threshold (800), and isotope exclusion window (4 Da) were used to enable or enhance the control sample comparison process. The output of the control sample comparison process consists of 1744 entries of potential drug metabolite ion peaks. However, over 95% of them are false positive hits unrelated to the drug metabolite ions. For example, of the top 20 highest intensity peaks, 15 of them are from sample matrix components. These results illustrate the problems of the extracted ion chromatogram-based control sample comparison approach in causing data degeneration and inaccurate chromatographic profiling when dealing with complex samples. They are in drastic contrast to the efficient results shown in FIG. 6*a*.

In another experimental analysis of methods in accordance with exemplary embodiments, analysis was conducted to detect endogenous metabolite biomarkers in dog plasma for a dog-specific toxicity that was related to a drug treatment. A plasma sample obtained from drug-treated dogs exhibiting the toxicity and two control plasma samples not exhibiting the toxicity were obtained and were analyzed using a commercially available LTQ FT instrument manufactured by Thermo Finnigan to generate the high resolution LC/MS data. The data of the drug-treated dog plasma sample was background-subtracted using the data of the control plasma samples.

This example first illustrates the use of two control samples for subtracting out sample matrix components in a test sample that are not relevant, so that the components of interest can be revealed. The background subtraction parameters were set as follows: chromatographic fluctuation time window, ±0.5 minute; mass precision window, ±20 ppm; multiplying factor applied to the maximal intensity of ions in a defined section of control sample data, 2.

Figures 7A, 7B, 7C, 7D:
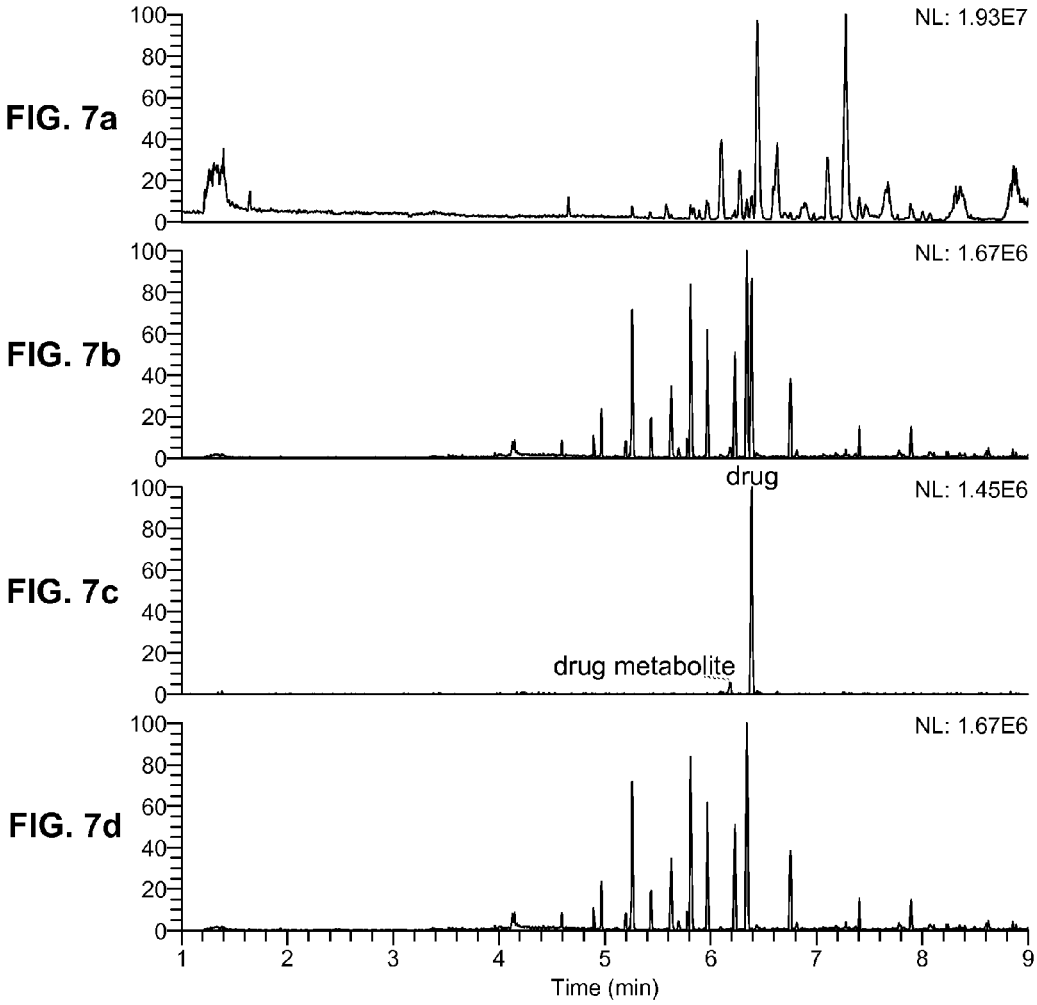
FIGS. 7*a* and 7*b* illustrate BPI chromatograms of a plasma sample of dogs in unprocessed and background-subtracted forms for the detection of endogenous metabolite markers.
FIGS. 7*c* and 7*d* illustrate using mass defect filtering to further exclude drug metabolite peaks from peaks of potential endogenous markers in the background-subtracted profile of the plasma sample.

As illustrated in FIG. 7*a*, without thorough removal of sample matrix components, peaks of potential biomarker are not easily identifiable in the original BPI chromatogram of the drug-treated dog plasma sample, as they are obscured by the presences of many other plasma matrix components. In contrast, as illustrated in FIG. 7*b*, these peaks are clearly observed after the background subtraction process.

This example further illustrates the utility of combining background subtraction with other data processing techniques to refine the detection of components of interest. The background-subtracted profile in FIG. 7*b* contains potential endogenous biomarkers but it also contains the dosed drug and some of its metabolites. Therefore, mass defect filtering was used to further classify the peaks in FIG. 7*b* into different groups. To segregate the drug and its oxidative metabolites, a mass defect filter was set based on the mass and mass defect of the drug, resulting in a mass defect range of 0.024 Da to 0.124 Da and a mass range of 440-540 Da [Zhang, et al, U.S. Pat. No. 7,381,568B2, Jun. 3, 2008]. After mass defect filtering, the segregated drug and drug metabolite peaks are illustrated in FIG. 7*c*. The remaining background-subtracted peaks, as shown in FIG. 7*d*, are endogenous metabolites that are potential biomarkers of interest.

In accordance with other exemplary embodiments, the background subtraction methods can be used in non-selective fragmentation experiments for obtaining clean fragment ion spectra, free of sample matrix interferences, for components of interest in a sample. A non-selective fragmentation experiment is an experiment in which all ionized components are indiscriminately fragmented in a mass spectrometer as oppose to a tandem mass spectrometry (MS/MS) experiment where a specific precursor ion (typically the molecular ion of a component) is selected, activated, and followed by subsequent analysis of the fragment ions (i.e., product ions) formed. A non-selective fragmentation experiment can be conducted through collision-induced dissociation (CID) without selecting a specific precursor ion. In other words, ions of all components are allowed to be activated as a result of the CID process. A non-selective CID experiment can be conducted in or near the ion source or in a collision cell as known in the art. In addition to a CID-based one, a non-selective fragmentation experiment can also be part of an ionization process, e.g., through electron impact (EI) ionization in which fragment ions of components are formed via unimolecular dissociation, as known in the art.

To obtain clean fragment ion spectra (also known as product ion spectra) comprising mainly relevant fragment ion information for components of interest in a complex sample, the test sample and its control samples are subject to a chromatography/high resolution mass spectrometry system to obtain their non-selective fragmentation data. The aforementioned precise and thorough background subtraction methods are applied to remove fragment ions arising from chemical background and extraneous sample components in the test sample. The resulting simplified data allow for obtaining clean fragment ion spectra for components of interest, and thus enabling proper fragmentation assignments and structural elucidation for components of interest.

For non-selective fragmentation experiments conducted in CID mode, both non-CID data set (containing mainly molecular ions of components) and CID data set (containing mainly fragment ions of components) can be obtained for the test and control samples. In accordance to other embodiments of the invention, the aforementioned precise and thorough background subtraction methods can be applied to both the non-CID data set to determine the molecular ions and to the CID data set to determine the fragment ions for the components of interest in the test sample. The chromatographic integrity of the outputs of both data sets allow for correlation of the molecular ions of a component with its corresponding fragment ions.

In an experimental analysis of methods in accordance with exemplary embodiments for obtaining clean fragment ion spectra for components of interest from non-selective fragmentation experiments, the aforementioned sample of buspirone human liver microsomal metabolites reconstituted in human plasma was analyzed. A control sample of human plasma containing human liver microsomes was used to provide sample matrix component coverage for the analysis of the buspirone sample. High resolution LC/MS data of both samples were generated from a commercially available Synapt QToF mass spectrometer manufactured by Waters, Manchester, UK. The LC/MS data were acquired using two alternating ToF scanning functions available to the instrument: the first at low collision energy (6V) producing a data set containing mainly molecular ions; the second at high collision energy (25 eV) producing a data set containing mainly fragment ions of all components in a non-selective way.

The low collision energy data set and the high collision energy data set of the buspirone human plasma sample were each background-subtracted using the corresponding data set of the control sample. The background subtraction was conducted with the following parameters: chromatographic fluctuation time window, ±0.3 minute; mass precision window, ±20 ppm; multiplying factor applied to the maximal intensity of ions identified in a defined section of a control sample data set, 2.

Figures 8A, 8B, 8C, 8D:
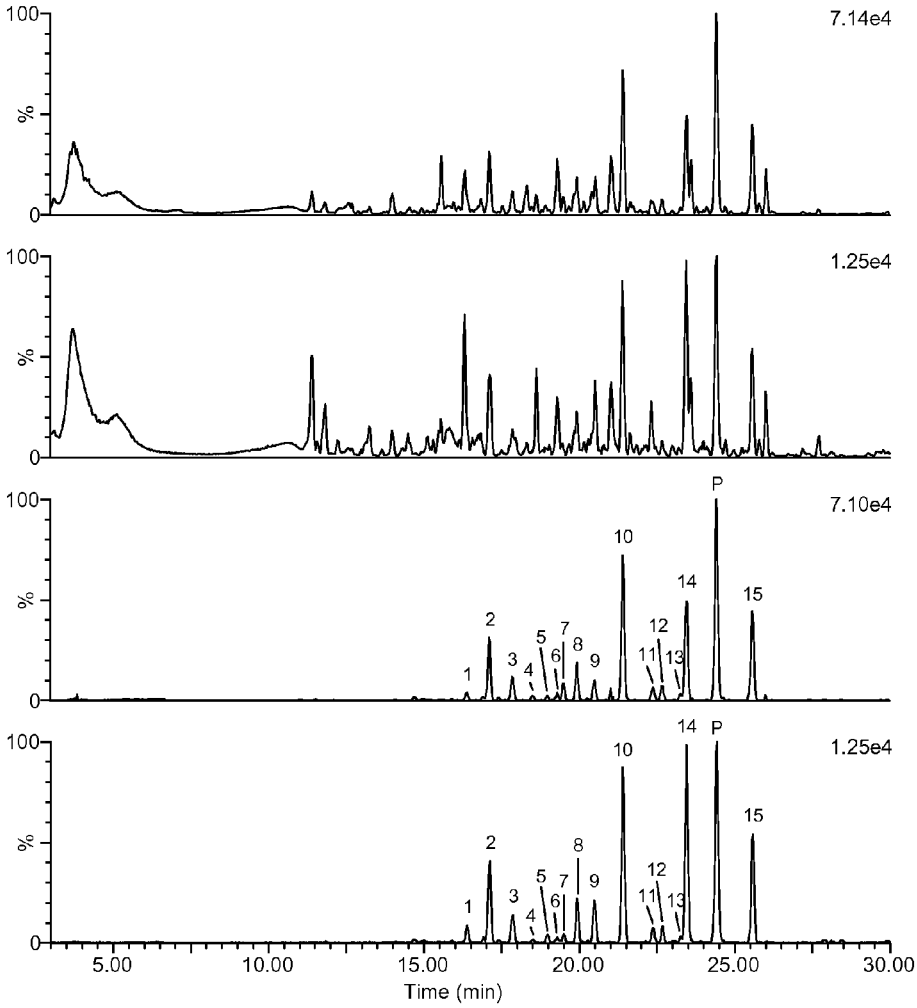
FIGS. 8*a*-8*d* illustrate BPI chromatograms of the molecular ion profiles and fragment ion profiles of buspirone metabolites in human plasma obtained from a non-selective CID experiment before and after the processing according to exemplary embodiments.

As illustrated in FIGS. 8*a* and 8*b*, the original unprocessed BPI chromatograms are dominated with significant plasma matrix peaks for both the low collision energy dataset and the high collision energy dataset of the buspirone metabolite sample in human plasma. In contrast, as illustrated in FIGS. 8*c* and 8*d*, these interference peaks are thoroughly removed and buspirone metabolites are revealed as the major distinct peaks in the background-subtracted profiles including the one of the high collision energy dataset (FIG. 8*d*). In addition, the buspirone metabolite profiles in FIGS. 8*c* and 8*d* are both comparable with the reference profile shown in FIG. 1*a*, demonstrating that the background subtraction methods are effective for identifying not only molecular ions for components of interest bus also their fragment ions. The chromatographic time correlation between the peak profiles of FIGS. 8*c* and 8*d* also provides the ability to properly assign fragment ions of components to their respective molecular ions, which is important for structural elucidation for components of interest. This is further illustrated below in exemplary spectral examinations.

Figure 9A:
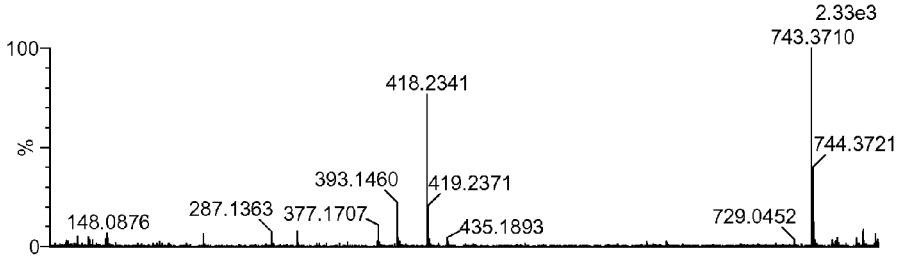
FIGS. 9*a*-9*d* illustrate molecular ion mass spectra and fragment ion mass spectra of a buspirone metabolite at a particular chromatographic time point before and after the processing according to exemplary embodiments.
Figure 9B:
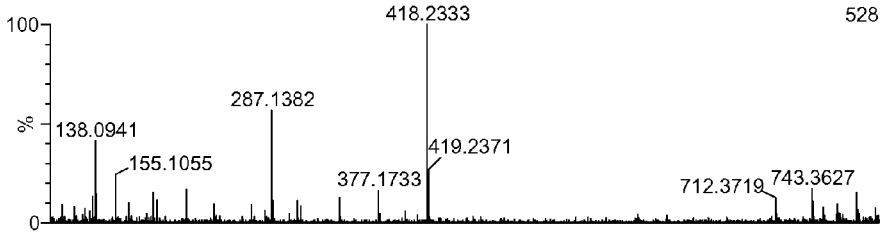
Figure 9C:
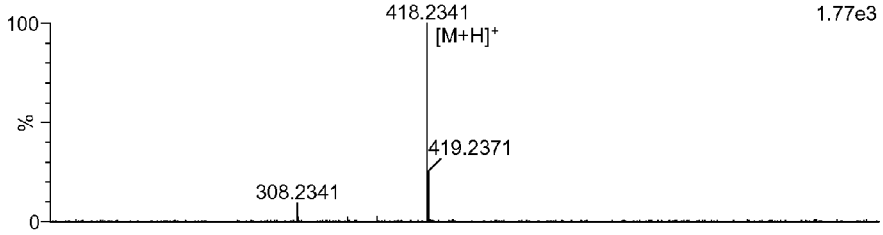
Figure 9D:
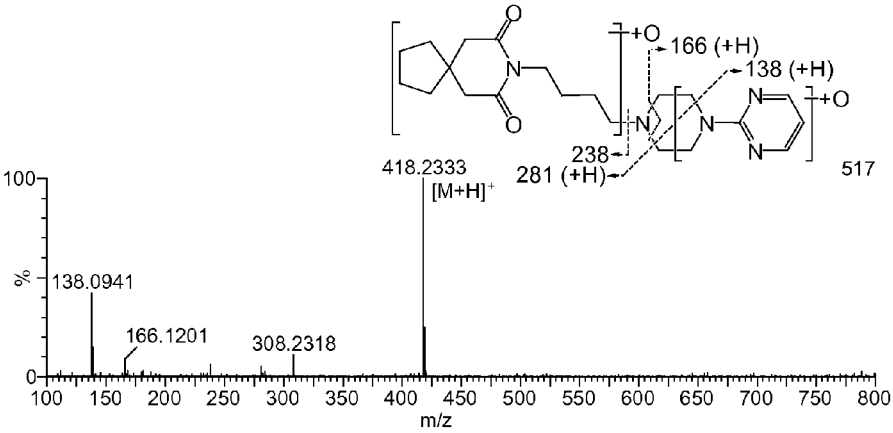

FIGS. 9*a* and 9*b* illustrate the original unprocessed MS and CID spectra for a chromatographic peak (buspirone metabolite M5) at a chromatographic time of RT 18.9 min. (MS spectra refer to molecular ion spectra obtained with low collision energy; CID spectra refer to fragment ion spectra obtained with high collision energy.) As can be seen, both the unprocessed MS and CID spectra show significant interference from plasma matrix components and therefore signals for the drug metabolite of interest are not obvious. In contrast, FIGS. 9*c* and 9*d* illustrate processed mass spectra for the same peak at the same chromatographic time point. In FIG. 9*c*, the protonated species of the metabolite at m/z 418 and one of its fragments at m/z 308 are prominent as the only major ions in the MS spectrum. More interestingly in FIG. 9*d*, all fragment ions of the metabolite are displayed as the only major ions in the CID spectrum at the same chromatographic time. The clean fragment ion spectrum of FIG. 9*d* allows for correct fragmentation assignment for the m/z 418 ion and structural elucidation of this metabolite at RT 18.9 min.

In accordance with other exemplary embodiments of the invention, the background-subtracted data sets from a non-selective CID experiment can be used for further processing with other data processing techniques. Given the chromatographic time correlation of the non-CID data set (containing mainly molecular ions) and the CID data set (containing mainly fragment ions), the background subtracted data significantly enhance the performance of several data processing techniques known in the art. Thus these data processing techniques constitute means for correlating ions of the same components between a molecular ion data set and a fragment ion data set after the background subtraction. For example, product ion filter and neutral loss filter can be applied to cross-exam the two background-subtracted datasets for more efficient identification of a particular subset of components of interest. For example, a neutral loss filter of 129 Da may be used to identify gluthathione conjugates of drug metabolites. Also, the two sets of data may be combined on a one-to-one basis at each chromatographic time point to give a chromatograph made up of spectra containing both the molecular ions and fragment ions for components of interest. In addition, Biller-Biemann algorithm [Biller J E, Biemann K. *Anal. Lett.* 1974; 7: 515] may be applied to the simplified data (either the two data sets or the combined data set) to reconstruct spectra for closely eluting components of interest.

Figure 10:
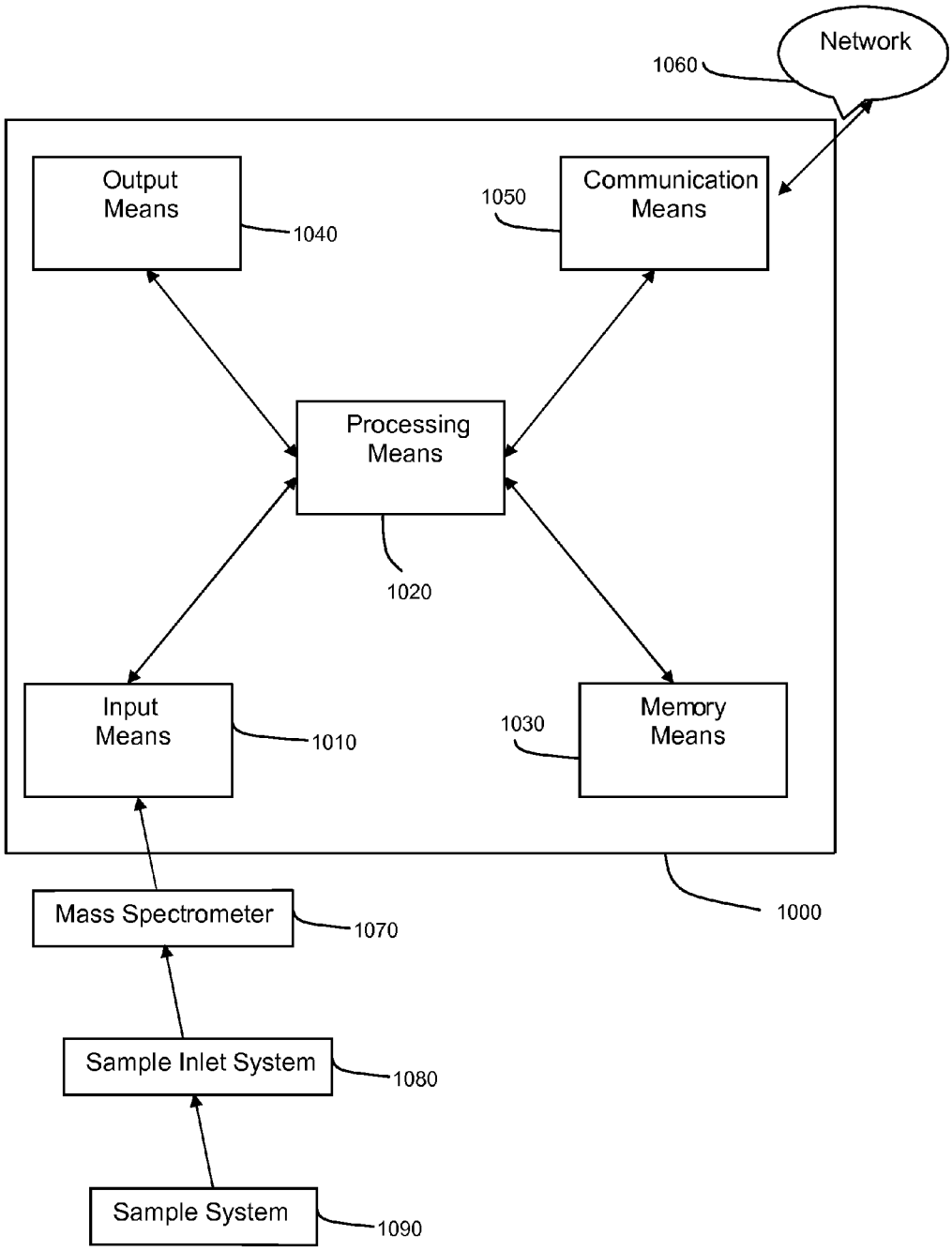
FIG. 10 illustrates a system in accordance with exemplary embodiments.

In exemplary embodiments, the methods described can be implemented on a computer such as computer 1000 illustrated of FIG. 10. Computer 1000 may be a handheld computer, a laptop computer, a desktop computer or the like. Computer 1000 may comprise an input means 1010, a processing means 1020, a memory means 1030, an output means 1040 and a communication means 1050. Input means 1010 may be a keyboard, a mouse or the like. The detected ions and their m/z, intensity, and chromatographic time information may, for example, be provided by a mass spectrometer 1070 to computer 1000 via input means 1010. The detected ions may also be received by computer 1000 via communication means 1050 over a network 1060. Network 1060 may, for example, be the Internet. An Ethernet cable may also facilitate the communication between the mass spectrometer 1070 and computer 1000.

The information of the detected ions, including the exact mass m/z values, intensities, and chromatographic times (or scan numbers), may be stored in memory means 1030. The specified chromatographic fluctuation time windows, mass precision windows, and multiplying factors applied to the maximal intensity of ions identified in defined sections of control sample data may also be received by computer 1000 and stored in memory means 1030. Output means 1040 may be a display (or monitor) or a printer. Data from computer 1000 may also be output to other devices via communication means 1050.

Processing means 1020 may be a well known processor such as that used in a personal computer for example. Processing means 1020 may be a plurality of processors. Processor 1020 may be programmed to define and examine sections of the control sample data within the specified time and mass precision windows around ions in the test sample data. Based on the examination, processor 1020 may subtract the maximal intensity of ions identified in the defined section of the control sample data from the intensities of ions in the test sample data. The original m/z and chromatographic time values of the ions in the test sample data and their new (or original) intensity values may be stored at a memory location within memory means 1030. The detection of ions and their m/z values, intensities, and chromatographic time information (or scan numbers) may be accomplished by the LTQ FT and Synapt QToF instruments mentioned above, or LTQ Orbitrap, or any mass spectrometer capable of exact mass measurements. In exemplary embodiments, samples may be provided to mass spectrometer 1070 by a liquid chromatography system 1080 or a similar sample inlet system. The sample system 1090 may be a test sample and one or more of its control samples, or a batch of test samples and their corresponding control samples.

Exemplary embodiments of the methods can also be programmed as a set of executable instructions on a computer readable medium. The medium may be a computer disk such as a floppy or a compact disc. The programmed instructions in the computer readable medium, in conjunction with a processor or a computer, may be executed by the processor to perform methods of the exemplary methods. Exemplary methods can also be implemented via hardware such as an application-specific integrated circuit (ASIC) programmed to perform the method as described.

In exemplary embodiments, a batch processing mode may be used to process a batch of datasets of test samples and their corresponding control samples. The same setting of background subtraction parameters (e.g., chromatographic fluctuation time window, mass precision window, and intensity multiplying factor, or some other pertinent parameters used in conjunction) may be applied to all datasets in the batch, or individual settings may be used for the processing of each test sample dataset.

In other embodiments, the precise and thorough background subtraction methods can also be used in conjunction with other data processing techniques. The background subtraction methods can be used to prepare data for subsequent processing by additional techniques, or they can be used to further process data that have been prepared by other data processing techniques, or they can be used simultaneously with other data processing techniques.

In other embodiments, the precise and thorough background subtraction methods may also be conducted with reversed roles of the test and control samples. Instead of defining sections of the control sample data, the methods may define sections of the test sample data around each ion in the control sample data based on the specified chromatographic fluctuation time and mass precision windows. Ions of the control sample data are subtracted based on ions identified in the respective sections of the test sample data. Such methods allow for identification of components of interest that are absent or decreased in the test samples relative to the control samples. Applications of such methods include, but are not limited to, the identification of biomarkers and/or down-regulated proteins whose decreases are of interest in certain studies.

In other embodiments, a variable chromatographic fluctuation time window can be used such that the time window for selecting a range of control sample data is wider (or narrower) for test sample data at a given chromatographic time point (and/or mass) than at a different time point (and/or mass). Similarly, a variable mass precision time window can be used such that the mass precision window for selecting a range of control sample data is more restrictive (or more tolerant) for test sample data at a given chromatographic time point (and/or mass) than at a different time point (and/or mass). In these cases, the chromatographic time and/or m/z boundaries for defining sections of control sample data can be viewed as a series of scalable sections along the chromatographic time and/or m/z scales based on the respective ions in question in the test sample data.

In other embodiments, a mass precision window may be set based on an absolute mass precision value (expressed as mDa, as known in the art), instead of a relative mass precision value (expressed as ppm).

While aforementioned embodiments have been highlighted for high resolution mass spectrometric data, exemplary embodiments of the present invention may also be used for low resolution mass spectrometric data obtained from, e.g., a qaudrupole or ion trap type of instrument. The mass precision of low resolution mass spectrometric data is generically poorer than that of high resolution mass spectrometric data, and therefore necessitates a relatively wider mass precision window setting. The application of the methods for low resolution mass spectrometric data is possible in cases where the major isobaric components are separated outside of the specified time window of the components of interest.

Aforementioned embodiments have been described with reference to drug metabolite and endogenous metabolite identification. It will be understood that the invention can be applied to other types of sample analyses where proper control samples can be obtained. Non-limiting examples of applications include drug impurity analysis in formulated drug products, identification of up-regulated or down-regulated proteins in digested cell lysate.

In accordance with the exemplary methods of the invention, a complex sample means any sample that contains components other than the components of interest whose signals are significant in the data. Components other than the components of interest can be from chemical background and sample matrix components; they can also be components in a sample that are not of interest for the purpose of the investigation. For example, the utility of the exemplary methods is demonstrated for the identification of glutathione conjugated drug metabolites in liver microsomal incubation samples [Zhang H, Yang Y. *J. Mass Spectrom.* 2008; 43:1181-1190]. In these exemplary cases, the oxidative drug metabolites typically overshadow the minor glutathione conjugates of interest in the unprocessed data. The oxidative drug metabolites are not of interest for the purpose of the investigation.

While the description has highlighted LC/MS analysis, exemplary embodiments of the present invention should also be effective for high resolution mass spectrometry coupled with separation techniques other than a liquid chromatography. Non-limiting examples of separation techniques other than a liquid chromatography that can be used in combination with high resolution mass spectrometry for the application of embodiments of the invention include capillary electrophoresis (CE) and gas chromatography (GC).

While the foregoing embodiments of the invention have been described in some detail for purposes of clarity and understanding, it will be appreciated by one skilled in the art, from a reading of the application, that various changes in form and detail can be made without departing from the true scope of the invention. The invention is therefore not to be limited to the exact components or details of methodology or construction set forth above. Except to the extent necessary or inherent in the processes themselves, no particular order to steps or stages of methods or processes described in this application, including the Figures, is intended or implied. In many cases the order of process steps may be varied without changing the purpose, effect, or import of the methods described.

The following claims and their equivalents define the scope of the invention.

We claim:

1. A method, comprising:

collecting a test sample and at least a control sample;

subjecting said test and control samples to a chromatography and high resolution mass spectrometry analysis;

obtaining at least a test sample data set and a control sample data set from said analysis, each data set comprising m/z, chromatographic time, and intensity information of detected ions, the data sets forming an initial chromatographic time range and an initial m/z range;

specifying a chromatographic fluctuation time window comprising a range of chromatographic time fluctuations;

specifying a mass precision window comprising a range of m/z measurement precisions;

applying said chromatographic fluctuation time window in said initial chromatographic time range and said mass precision window in said initial m/z range around ions in said test sample data set to define sections of data in said control sample data set;

providing a first means for subtracting ions in said test sample data set based on examination of the maximal intensities of ions in respective sections of said control sample data set;

whereby said sections of data in the control sample data set allow for precise and thorough examination so that ions of sample matrix components that are present in both said control sample and said test sample are reliably captured and maximally subtracted from said test sample data set, and ions of components of interest in said test sample become apparent for identification in the resultant data.

2. The method in claim 1, wherein said first means for subtracting ions in the test sample data set comprises:

subtracting the maximal intensities of ions presented within respective sections of said control sample data set from the intensities of ions in said test sample data set;

in the event no ion is present in a section of said control sample data set, keeping the intensity of the ion in said test sample data set for which said section is defined.

3. The method in claim 1, wherein said first means for subtracting ions in the test sample data set comprises:

applying a predetermined multiplying factor to the maximal intensities of ions presented within sections of said control sample data set to obtain scaled values of said maximal intensities; and subtracting said scaled values of the maximal intensities in respective sections of said control sample data set from the intensities of ions in said test sample data set;

in the event no ion is present in a section of said control sample data set, keeping the intensity of the ion in said test sample data set for which the section is defined.

4. The method in claim 1, wherein said at least one control sample is a plurality of control samples, whereby data sets of said plurality of control samples are used for defining said sections of data.

5. The method in claim 1, wherein said chromatographic fluctuation time window and said mass precision window are applied to discrete ions in said test sample data set to define sections of data in said control sample data set.

6. The method in claim 1, wherein said chromatographic fluctuation time window and said mass precision window are applied around groups of same ions that appear at consecutive chromatographic time values in said test sample data set to define sections of data in said control sample data set, said same ions that appear at consecutive chromatographic time values have m/z values falling within a second predetermined mass precision window.

7. The method in claim 1, further comprising providing a second means for reducing random noise in said test sample data set, said second means comprising:

determining the randomness of ion appearance in said initial chromatographic time range for ions in said test sample data set; and removing those ions that are determined to be random from said test sample data set;

whereby the combined use of said first means and said second means allows the identification of minor components of interest that are present in said test sample.

8. The method in claim 7, wherein ions are determined to be random if their equivalent m/z ions within a third predetermined mass precision window are absent in said test sample data set at adjacent chromatographic time points immediately before and after them.

9. The method in claim 7, wherein the step of providing said second means to reduce random noise proceeds before the step of applying said chromatographic fluctuation time window and said mass precision window around ions in said test sample data set to define sections in said control sample data set.

10. The method in claim 1, further comprising providing a third means for processing ions in said test sample data set, said third means being distinct from said first means;

whereby the combined use of said first means and said third means refines the identification of components of interest.

11. The method in claim 10, wherein said third means comprises a mass defect filter.

12. The method in claim 1, wherein said test sample and control sample data sets comprise mainly molecular ions of components, said molecular ions form said initial chromatographic time range and said initial m/z range;

whereby after the step of providing said first means for subtracting ions in said test sample data set, the molecular ions of components of interest in said test sample become apparent in the resultant data.

13. The method in claim 1, wherein said test sample and control sample data sets comprise mainly fragment ions of components, said fragment ions form said initial chromatographic time range and said initial m/z range;

whereby after the step of providing said first means for subtracting ions in said test sample data set, the fragment ions of components of interest in said test sample become apparent in the resultant data, allowing observation of clean fragment ion spectra for components of interest.

14. The method in claim 1, further comprising obtaining a second test sample data set and a second control sample data set, in addition to said test sample data set and said control sample data set, from said analysis;

wherein said second data sets form a second chromatographic time range and a second m/z range;

wherein said chromatographic fluctuation time window and said mass precision window are also applied to ions in said second test sample data set to define sections of data in said second control sample data set;

wherein said first means is also provided for subtracting ions in said second test sample data set based on examination of the maximal intensities of ions in respective sections of said second control sample data set;

whereby when said first data sets comprising mainly molecular ions and said second data sets comprising mainly fragment ions, both the molecular ions and the fragment ions of components of interest in said test sample become apparent for identification in the resultant data.

15. The method in claim 14, further comprising providing a fourth means for correlating ions of the same components between said test sample data set and said second test sample data set after the step of providing said first means for subtracting ions in each test sample data set, said fourth means being based on chromatographic time correlation for ions of said same components between said test sample data set and said second test sample data set;

whereby the combined use of said first means and said fourth means refines the identification and characterization of components of interest in said test sample.

16. The method in claim 15, wherein said fourth means is a neutral loss filter.

17. The method in claim 1, wherein said chromatographic fluctuation time window is scalable based on ions in said test sample data set.

18. The method in claim 1, wherein said mass precision window is scalable based on ions in said test sample data set.

19. The method in claim 1, wherein said chromatography is liquid chromatography, gas chromatography, electrophoresis, or any other component-separating technique that can be coupled with mass spectrometry.

20. A system for detecting and identifying components of interest in complex samples, said system comprising:

a test sample comprising components of interest and at least a control sample comprising sample matrix components of said test sample;

a chromatography and high resolution mass spectrometry to detect ions of components in said test and control samples;

a processor configured to execute instructions which cause the system to perform a method comprising:

obtaining at least a test sample data set and a control sample data set, each data set comprising m/z, chromatographic time, and intensity information of detected ions, the data sets forming an initial chromatographic time range and an initial m/z range;

specifying a chromatographic fluctuation time window comprising a range of chromatographic time fluctuations;

specifying a mass precision window comprising a range of m/z measurement precisions;

applying said chromatographic fluctuation time window in said initial chromatographic time range and said mass precision window in said initial m/z range around ions in said test sample data set to define sections of data in said control sample data set;

providing a first means for subtracting ions in said test sample data set based on examination of the maximal intensities of ions in respective sections of said control sample data set;

whereby said sections of data in the control sample data set allow for precise and thorough examination so that ions of sample matrix components that are present in both said control sample and said test sample are reliably captured and maximally subtracted from said test sample data set, and ions of components of interest in said test sample become apparent for identification in the resultant data.

21. A computer readable medium containing executable instructions which, when executed in a processing system, cause the system to perform a method comprising:

obtaining at least a test sample data set and a control sample data set, each data set comprising m/z, chromatographic time, and intensity information of ions detected from a chromatography and high resolution mass spectrometry process, the data sets forming an initial chromatographic time range and an initial m/z range;

specifying a chromatographic fluctuation time window comprising a range of chromatographic time fluctuations;

specifying a mass precision window comprising a range of m/z measurement precisions;

applying said chromatographic fluctuation time window in said initial chromatographic time range and said mass precision window in said initial m/z range around ions in said test sample data set to define sections of data in said control sample data set;

providing a first means for subtracting ions in said test sample data set based on examination of the maximal intensities of ions in respective sections of said control sample data set;

whereby said sections of data in the control sample data set allow for precise and thorough examination so that ions of sample matrix components that are present in both said control sample and said test sample are reliably captured and maximally subtracted from said test sample data set, and ions of components of interest in said test sample become apparent for identification in the resultant data.

* * * * *